US006958002B1

(12) United States Patent
Palaparthi

(10) Patent No.: US 6,958,002 B1
(45) Date of Patent: Oct. 25, 2005

(54) POLISHING PAD WITH FLOW MODIFYING GROOVE NETWORK

(75) Inventor: Ravichandra V. Palaparthi, Newark, DE (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 10/894,915

(22) Filed: Jul. 19, 2004

(51) Int. Cl.[7] ..... B24B 7/22
(52) U.S. Cl. ..... 451/36; 451/527
(58) Field of Search ..... 451/36, 37, 41, 451/527, 530, 283, 285, 287, 548, 921

(56) References Cited

U.S. PATENT DOCUMENTS 5,645,469 A 7/1997 Burke et al.
5,690,540 A * 11/1997 Elliott et al. ..... 451/41
5,921,855 A 7/1999 Osterheld et al.
6,093,651 A 7/2000 Andideh et al.
6,120,366 A 9/2000 Lin et al.
6,241,596 B1 * 6/2001 Osterheld et al. ..... 451/527
6,273,806 B1 8/2001 Bennett et al.
6,843,709 B1 * 1/2005 Crkvenac et al. ..... 451/41
6,843,711 B1 * 1/2005 Muldowney ..... 451/527
2001/0044263 A1 11/2001 Andideh et al.

* cited by examiner

*Primary Examiner*—Jacob K. Ackun, Jr.
(74) *Attorney, Agent, or Firm*—Blake T. Bioderman

(57) ABSTRACT

A polishing pad (20) for polishing a wafer (32) or other article, the pad having a groove network (60) configured to vary the residence time across the wafer track of the reaction products formed by the interaction of reactants in the polishing medium (46) with structure on the wafer. The groove network has a first portion (72) that may extend substantially radially outward and a second portion (74) that is configured to vary the speed of the radially outward flow of the polishing medium.

10 Claims, 5 Drawing Sheets

POLISHING PAD WITH FLOW MODIFYING GROOVE NETWORK

BACKGROUND OF THE INVENTION

The present invention generally relates to the field of chemical mechanical polishing. In particular, the present invention is directed to a chemical mechanical polishing pad having a groove network designed to optimize polishing medium residence time across the article being polished.

In the fabrication of integrated circuits and other electronic devices, multiple layers of conducting, semiconducting and dielectric materials are deposited onto and etched from a surface of a semiconductor wafer. Thin layers of conducting, semiconducting and dielectric materials may be deposited by a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the uppermost surface of the wafer becomes non-planar. Because subsequent semiconductor processing (e.g., photolithography) requires the wafer to have a flat surface, the wafer needs to be planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as semiconductor wafers. In conventional CMP using a dual-axis rotary polisher, a wafer carrier, or polishing head, is mounted on a carrier assembly. The polishing head holds the wafer and positions the wafer in contact with a polishing layer of a polishing pad within the polisher. The polishing pad has a diameter greater than twice the diameter of the wafer being planarized. During polishing, each of the polishing pad and wafer is rotated about its concentric center while the wafer is engaged with the polishing layer. The rotational axis of the wafer is generally offset relative to the rotational axis of the polishing pad by a distance greater than the radius of the wafer such that the rotation of the pad sweeps out a ring-shaped "wafer track" on the polishing layer of the pad. The radial distance between radially inner and outer boundaries of the wafer track defines the width of the wafer track. This width is typically equal to the diameter of the wafer when the only movement of the wafer is rotational. The carrier assembly provides a controllable pressure between the wafer and polishing pad. During polishing, a fresh polishing medium, e.g., polishing medium, is dispensed close to the rotational axis of the pad within the inner boundary of the wafer track. The polishing medium enters the wafer track from the inner boundary, flows into the gap between the wafer and the pad, contacts the wafer surface, and exits the wafer track at its outer boundary close to the edge of the pad. This movement of the polishing medium occurs in a substantially radially outward direction due to the centrifugal force induced on the polishing medium as a consequence of rotation of the pad. The wafer surface is polished and made planar by chemical and mechanical action of the polishing layer and polishing medium on the surface.

In a typical CMP process involving the use of reactants in the polishing medium, when the polishing medium is exposed to the wafer surface within the wafer track of the pad, the reactants interact with features on the wafer being polished, e.g., copper metallurgy, thereby forming reaction products. As the dispensed polishing medium flows from the inner boundary to the outer boundary of the wafer track, the residence time for the polishing medium under the wafer surface increases. Interaction of the polishing medium with the wafer material causes a variation in relative proportions of the reactants and reaction products in the polishing medium, as measured along a radius of the pad. The polishing medium near the inner boundary of the wafer track has a relatively high proportion of reactants (much like fresh polishing medium), and the polishing medium near the outer boundary of the wafer track has a relatively low proportion of reactants and a relatively high proportion of reaction products (much like spent polishing medium).

Polishing reaction rates in general may depend differently on the concentrations of reactants and products in the polishing medium. Hence polishing at any given location on the wafer is influenced by the relative proportions of reactants and reaction products in the polishing medium exposed to. Furthermore, an increase in the relative amount of reaction product at a given location will typically either increase or decrease the polishing rate at that location, all other factors being equal. To achieve the polishing rates across the entire wafer necessary to obtain a planar surface, it is not enough to merely control the quantity of polishing medium available to the wafer at a given radial location. Instead all locations on the wafer should be uniformly exposed to polishing medium containing different concentration levels of reactants and the reaction products. Unfortunately, known CMP systems and associated polishing pads do not typically distribute polishing medium in such a manner.

It is known to provide outward extending grooves in a polishing pad that have decreasing depth so as to slow the radial flow rate of slurry applied to the pad. Such a groove pattern is described in U.S. Pat. No. 5,645,469 to Burke et al. While the groove pattern described in the '469 patent may slow the radial flow rate of slurry to some extent, it does so using straight, radially extending grooves, the depth of which begin decreasing at an equal radial distance from the center axis of the pad.

STATEMENT OF THE INVENTION

In one aspect of the invention, a polishing pad for polishing an article, the polishing pad comprising a polishing portion having a rotational axis and a plurality of grooves, each groove including: (i) a first portion; and (ii) a second portion in communication with the first portion at a transition location; and wherein the transition location of at least a first one of the plurality of grooves is spaced a first radial distance from the rotational axis and the transition location of at least a second one of the plurality of grooves is spaced a second radial distance from the rotational axis, the first radial distance being different than the second radial distance.

In another aspect of the invention, a method of polishing an article using a polishing pad having a rotational axis and a polishing medium having at least one constituent that interacts with features in the article so as to create a first product, the method comprising the steps of: (a) providing a pad having a plurality of grooves that extends outward from the rotational axis; (b) engaging the pad with a surface of the article; (c) effecting relative rotation between the pad and the article so that a track of the pad contacts the article;

and (d) causing the polishing medium to flow between the track of the pad and the surface of the article within the plurality of grooves with different residence times in at least two of the plurality of grooves.

In another aspect of the invention, a polishing pad for polishing an article with the use of a polishing medium, the pad comprising: (a) a polishing portion having rotational axis and a plurality of grooves, each groove including: (i) a first portion; and (ii) a second portion in communication with the first portion at a transition location, the second portion having a length and a cross-sectional configuration that varies along at least a portion of the length so as to increase residence time of polishing medium located in the second portion; and (b) wherein the transition location of each of the plurality of grooves is spaced one of a plurality of different radial distances from the rotational axis.

DETAILED DESCRIPTION OF THE INVENTION

Figure 1:
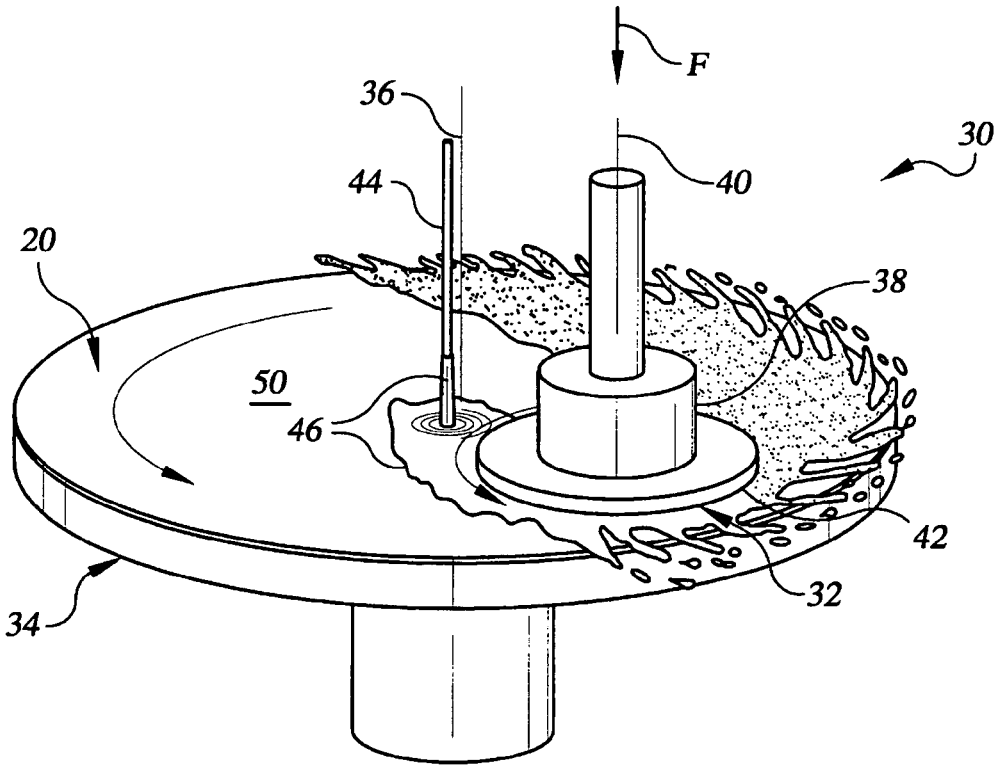
FIG. 1 is a perspective view of a portion of a dual-axis polisher suitable for use with the present invention.

Referring to FIG. 1, the present invention is a polishing pad 20 usable with a chemical mechanical polishing (CMP) polisher 30 for planarizing a wafer 32 or other workpiece. References to wafer 32 are intended to include other workpieces as well, except when the context of use clearly indicates otherwise. As described below, polishing pad 20 is designed to distribute residence time of polishing medium used in a CMP process so as to enhance uniformity of planarization of wafer 32.

Before describing polishing pad 20 in detail, a brief description of polisher 30 is provided. Polisher 30 may include a platen 34 on which polishing pad 20 is mounted. Platen 34 is rotatable about a rotational axis 36 by a platen driver (not shown). Wafer 32 may be supported by a wafer carrier 38 that is rotatable about a rotational axis 40 parallel to, and spaced from, rotational axis 36 of platen 34. Wafer carrier 38 may feature a gimbaled linkage (not shown) that allows wafer 32 to assume an aspect very slightly non-parallel to polishing pad 20, in which case rotational axes 36 and 40 may be very slightly askew. Wafer 32 includes polished surface 42 that faces polishing pad 20 and is planarized during polishing. Wafer carrier 38 may be supported by a carrier support assembly (not shown) adapted to rotate wafer 32 and provide a downward force F to press polished surface 42 against polishing pad 20 so that a desired pressure exists between the polished surface and the polishing pad during polishing. Polisher 30 may also include a polishing medium inlet 44 for supplying polishing medium 46 to polishing pad 20. Polishing medium inlet 44 should generally be positioned at or close to rotational axis 36 to optimize the effectiveness of polishing pad 20, although such placement is not a requirement for operation of the polishing pad.

As those skilled in the art will appreciate, polisher 30 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 32 and polishing pad 20; (2) controllers and selectors for varying the rate and location of delivery of polishing medium 46 to the pad; (3) controllers and selectors for controlling the magnitude of force F applied between the wafer and pad, and (4) controllers, actuators and selectors for controlling the location of rotational axis 40 of the wafer relative to rotational axis 36 of the pad, among others. Those skilled in the art will understand how these components are constructed and implemented such that a detailed explanation of them is not necessary for those skilled in the art to understand and practice the present invention. While polishing pad 20 works effectively with a polisher such as polisher 30 described above, the pad may also be used with other polishers.

During polishing, polishing pad 20 and wafer 32 are rotated about their respective rotational axes 36 and 40, and polishing medium 46 is dispensed from polishing medium inlet 44 onto the rotating polishing pad. Polishing medium 46 spreads out over polishing pad 20, including into the gap beneath wafer 32 and the polishing pad. Polishing pad 20 and wafer 32 are typically, but not necessarily, rotated at selected speeds between 0 rpm and 150 rpm. Force F is typically, but not necessarily, of a magnitude selected to induce a desired pressure of 0.1 psi to 15 psi (0.7 to 103 kPa) between wafer 32 and polishing pad 20.

Polishing pad 20 has a polishing layer 50 for engaging an article, such as semiconductor wafer 32 (processed or unprocessed) or other workpiece, e.g., glass, flat panel display or magnetic information storage disk, among others, so as to effect polishing of the polished surface of the workpiece in the presence of a polishing medium 46 or other polishing medium. For the sake of convenience, the terms "wafer" and "polishing medium" are used below without the loss of generality.

Figure 2:
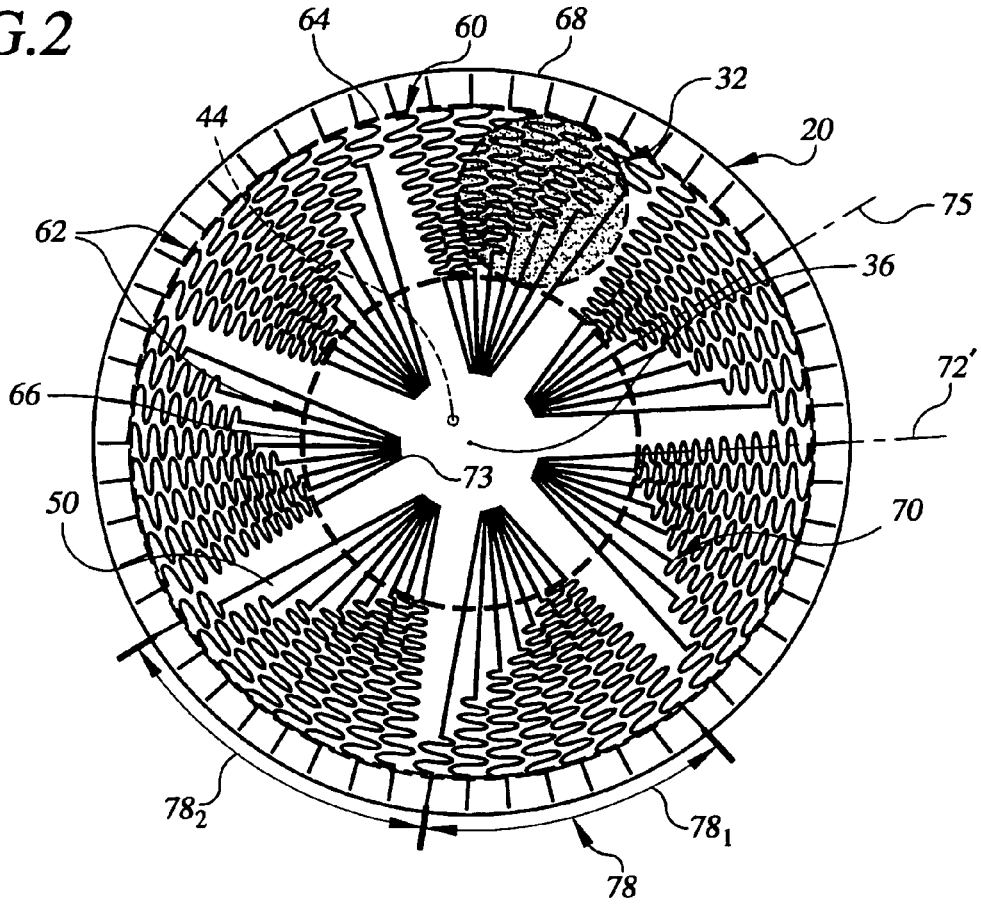
FIG. 2 is a top view of the one embodiment of the polishing pad of the present invention, with the outline of a wafer to be polished shown in phantom view.
Figure 3:
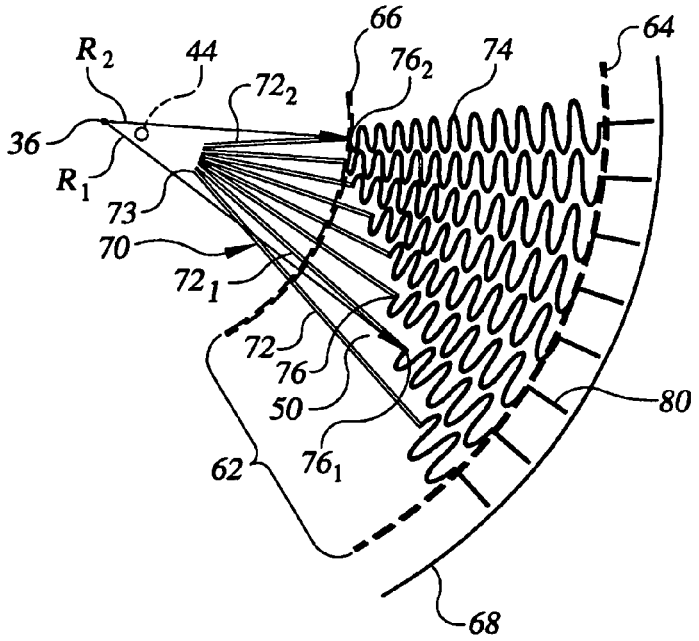
FIG. 3 is an enlarged top view of a section of the pad shown in FIG. 2.

Turning now to FIGS. 1–3, polishing pad 20 includes a groove network 60 designed to distribute residence time within the groove network of reaction products formed by the interaction of reactants in polishing medium 46 with portions of wafer 32 being polished. Polishing pad 20 includes a wafer track 62 defined by an imaginary radially outer circle 64 and an imaginary radially inner circle 66. Wafer track 62 is the portion of polishing pad 20 that actually polishes wafer 32. Outer circle 64 is typically positioned radially inward of periphery 68 of polishing pad 20 and inner circle 66 is typically positioned radially outward of rotational axis 36 of the polishing pad.

Groove network 60 includes a plurality of grooves 70 that aid in the transport of polishing medium 46 radially outward toward periphery 68 of polishing pad 20. Grooves 70 include a first portion 72 that extends substantially radially outward from rotational axis 36. For the purposes of this specification, major axis 72' of first portion 72 represents the center line of first portion 72 as it extends from a location near rotational axis 36 towards periphery 68. As used herein, "substantially radially" includes divergence of the major axis from a perfectly radial direction of up to 30 degrees. Typically, major axis 72' of first portion 72 has a substantially straight configuration, although the major axis first portion may also have a curved configuration. This curved configuration may include, for example a gentle curve or a curve that wraps partially or entirely around rotational axis 36. The curve of first portion 72 may be wholly or partially contained within inner circle 66. In an exemplary embodiment of polishing pad 20, grooves 70 in first portion 72 have a width in the range of 5–50 mils (0.127–1.27 mm) and a depth in the range of 10 to 50 mils (0.254–1.27 mm).

The width and depth of grooves 70 in first portion 72 will vary depending upon desired polishing performance, number of grooves 70 provided, desired polishing medium residence time and other factors.

First portion 72 is generally formed so that its radially inner end 73 (FIG. 3) is positioned radially inward of inner circle 66 and is positioned relatively close to rotational axis 36. The exact placement of inner end 73 will be influenced by the location of polishing medium inlet 44, with it generally being desirable to locate inner end 73 so that it will be radially outward of the polishing medium inlet. This relative placement is not required, however, and those skilled in the art will empirically determine the optimal relative placement of inner end 73 with respect to polishing medium inlet 44. In FIG. 3, a suitable location for polishing medium inlet 44 is depicted in phantom view. This location should be viewed as representative and not limiting.

Grooves 70 also include a second portion 74 that is positioned radially outward of first portion 72. First portion 72 is connected to second portion 74 at transition point 76, and is in fluid communication with the second portion. As illustrated in FIGS. 2 and 3, in one embodiment second portion 74 has a sinusoidal configuration, the amplitude of which increases moving outward from rotational axis 36. As an alternative or additional feature, second portion 74 may be designed so its sinusoidal configuration has an increasing frequency, moving outward from rotational axis 36. For the purposes of this specification, the frequency represents the cycles per unit distance along major axis 75 of second portion 74. This is inversely proportional to the wavelength of second portion 74, which is the distance along major axis 75 over which one cycle of second portion 74 extends. While not preferred in many applications, in some cases it may be appropriate to design sections of second portion 74 of one or more grooves 70 so that one or both of the amplitude and frequency decreases, moving radially outward from rotational axis 36. The change in amplitude and frequency of second portion 74 is generally linear, although the present invention encompasses step functions and other non-linear changes. The wavelength of second portion 74 is typically less, and often substantially less, than the radius of polishing pad 20, as measured between rotational axis 36 and periphery 68.

In an exemplary embodiment of pad 20, second portion 74 has an amplitude that increases from 0.1" to 2.0" (2.54 mm to 50.00 mm) proximate to the transition point 76 to 1 to 5" (25.4 to 126 mm) at the radially outermost portion of the second portion. The frequency of second portion 74 in this embodiment increases from 0.1–1 cycles per cm, as measured along major axis 75 of second portion 74 between transition point 76 and the radially outermost portion of the second portion. The amplitude and frequency are dependent on the dimensions (width and depth) of groove 70.

Second portion 74 has a major axis 75 that extends outward from rotational axis 36. Major axis 75 may extend substantially radially outward from rotational axis 36. As used herein, "substantially radially" includes divergence of major axis 75 from a perfectly radial direction of up to 30 degrees. Typically, major axis 75 of second portion 74 has a substantially straight configuration, although the major axis of second portion may also have a curved configuration.

For many applications, grooves 70 have a smoothly curved configuration at the peak and trough sections of the sinusoid defining second portion 74, as illustrated in FIGS. 2 and 3. In some applications, however, a sharp transition may be provided at the peak and trough sections such that second portion 74 has a zig-zag configuration.

Grooves 70 in second portion 74 generally have a constant width, as illustrated in FIGS. 2 and 3. The invention is not so limited, however. Grooves 70 may have a width that changes over the length of the grooves, as described below in connection with other embodiments of the invention. Further, residence time may be influenced by modifying the depth of grooves 70 in second portion 74, as also described below in connection with another embodiment of the invention. In an exemplary embodiment of the invention, grooves in second portion 74 have a uniform width, ranging from 10–100 mils (0.254–2.54 mm). In the case of grooves 70 with varying width, the width of grooves 70 typically increases progressively from the width at transition point 76 to the point of greatest width. The point of greatest width for grooves 70 is typically at outer circle 64 and the width may, if desired, decrease as the grooves continue radially outward toward peripheral edge 68.

As shown in FIG. 2, grooves 70 may be distributed in groove groups 78. The radial distance that transition points 76 of grooves 70 are spaced from rotational axis 36 may differ among the grooves within a groove group 78. For example, with reference to FIG. 3, transition point $\mathbf{76}_1$ of first portion $\mathbf{72}_1$ is positioned a radial distance $R_1$ from rotational axis 36 that is greater than the radial distance $R_2$ transition point $\mathbf{76}_2$ of first portion $\mathbf{72}_2$ is spaced from rotational axis 36. Typically, transition points 76 are positioned radially outward of inner circle 66, although in some cases it may be desirable to position some transition points 76 radially inward of inner circle 66. In general, transition point 76 of the ones of grooves 70 having first portions 72 positioned closest to rotational axis 36 is spaced about 0.25" to 3" (6.35 mm to 76.2 mm) from the rotational axis 36.

Within a given groove group 78, transition points 76 typically, but not necessarily, are spaced progressively radially further from rotational axis 36, as measured from one side of the groove group to the other. For example, as illustrated in FIG. 3, moving from left to right, the transition point 76 of the second groove 70 is closer to rotational axis 36 than the transition point of the first groove, and the transition point of the third groove is closer to rotational axis 36 than the transition point of the second groove. As a result of this arrangement, as viewed within wafer track 62, certain grooves 70 will consist principally of first portion 72, other grooves 70 will consist principally of second portion 74, and yet other grooves 70 will include a blend of the first portions and second portions. Other arrangements of transition points 76 are also encompassed by the present invention. In any event, as discussed more below, transition points 76 of grooves 70 are selected so as to optimize the residence time of the constituents of polishing medium 46 in grooves 70.

Polishing pad 20 will often include a number of groove groups 78, such as groove group $\mathbf{78}_1$ and adjacent groove group $\mathbf{78}_2$. Preferably the polishing pad has at least two groove groups 78. Most preferably, groove groups 78 contain the same groove patterns. The groove groups 78 typically have a similar configuration, and the number of groove groups on polishing pad 20 is a matter of design choice that will be influenced by empirical testing. In general, groove groups 78 cover the entire polishing pad 20 such that no large sections of the pad lack grooves 70. Further, the grooves 70 within a groove group 78 are typically positioned as close to one another as possible, although this is not a requirement of the invention.

The present invention includes groove groups 78 having a differing configuration as among the various groove groups on polishing pad 20 relative to the placement of transition point 76 and the existence and configuration of second portion 74. For example, some groove groups 78 may have transition points 76 for grooves 70 in the group that are spaced a radial distance from rotational axis 36 that increases or decreases progressively as measured in a one, e.g., clockwise, direction. Other groove groups 78, for example, may have transition points 76 for grooves 70 in the group that are spaced radial distances from rotational axis 36, as measured in one, e.g., clockwise, direction, that differ from one another in a non-regular manner. Yet other groove groups 78, for example, may include one or more grooves 70 having only first portions 72 or only second portions 74.

Second portions 74 may extend radially outward to periphery 68, to outer circle 64 or to a point radially inward of the outer circle. The desired residence time for polishing medium 46 will be a primary influence on where second portions 74 terminate, although other design and operational criteria may also influence such placement.

When second portions 74 terminate radially inward of periphery 68, it may be desirable to provide peripheral portions 80 in fluid communication with second portions 74. Peripheral portions 80 lack the oscillating path configuration of second portions 74. Peripheral portions 80 may extend straight radially outward toward periphery 68 relative to rotational axis 36, may be straight but extend outward at an angle relative to radii extending out from rotational axis 36 or may extend in a curved manner outward toward the periphery. While often desirable, peripheral portions 80 are an optional feature of groove network 60.

With continuing reference to FIGS. 1–3, the use and operation of polishing pad 20 is now discussed. As noted above, polishing pad 20 is particularly, although not necessarily, adapted for use with polishing medium 46 having abrasives, reactants, and after some use, reaction products. Polishing medium 46 is introduced proximate rotational axis 36, e.g., via polishing medium inlet 44, and then travels radially outward due to the centrifugal force imparted to the polishing medium by the rotation of polishing pad 20. Polishing medium 46 travels radially outward principally in first portions 72 of grooves 70, although some small amount of polishing medium may be transported outward in the regions between the grooves.

As polishing medium 46 contacts wafer 32, reactants in the polishing medium interact with features on the wafer, e.g., copper metallurgy, thereby forming reaction products. Depending upon the chemistry of polishing medium 46, the composition of features in wafer 32 with which the reactants react, and other factors, the polishing reaction rates may be affected differently by the reactants and products. The overall polishing rates may decrease or increase with the relative proportions of the reactants and products in the polishing medium. Groove configurations in known polishing pads do not typically ensure that the wafer track has a uniform distribution of polishing medium containing different concentration levels of reactants and the reaction products. Because of the aforementioned influence that the reaction products have on polishing rates, it tends to be difficult to achieve uniform planarization of the wafer being polished when using polishing medium compositions that result in the formation of reaction products. Controlling the residence time distribution of the polishing medium in the wafer track of the pad, we can control the distribution of polishing medium containing different concentration levels of reactants and the reaction products.

In each of the grooves 70, second portion 74 slows the radially outward movement of polishing medium relative to the movement of such polishing medium in first portion 72 by causing the polishing medium to travel along an oscillating path. This change in path of polishing medium 46 will generally occur rapidly, i.e., as a step function, at transition point 76. In other words, the residence time of polishing medium 46 will typically increase immediately as the polishing medium moves radially outward of transition point 76. If a slower transition is desired for certain applications, however, this can be readily accommodated, for example, by configuring the sections of oscillating portion 74 near transition point 76 to have a very gentle curvature that increases in amplitude and frequency when moving outward from rotational axis 36. Depending on the location of the transition point 76 of the groove 70, certain locations of the wafer 32 may contact polishing medium that has flown only in the first portion 72 while others contact the polishing medium that has flown through both first and second portions.

By increasing the residence time of polishing medium 46 at any given location along radii intersecting second portion 74, the polishing medium's reactants and reaction products are held in proximity to wafer 32 longer than would typically be the case for groove patterns known in the prior art. Depending on the differences in residence times per unit radial distance for the polishing medium between the first and second portions of the groove 70, the change in relative proportions of the reactants and products in the polishing medium per unit radial distance is different between the first and second portions. Due to the dependence of the polishing reaction rates on the relative proportions of the reactants and products in the polishing medium, there will be differences in the polishing rates between locations on a wafer's surface that contact the polishing medium flown only through the first portion of the groove 70 and those that contact the polishing medium flown through both the first and second portions. By having grooves 70 distributed in a groove group 78 such that each of the grooves has a different radial location within the wafer track where the transition occurs from a first portion to the second portion, different locations on the wafer can be more uniformly exposed to the polishing medium that had different residence times in contact with the wafer.

In determining the optimum configuration for second portion 74, the best placement for transition points 76, and other aspects of the design of polishing pad 20, a design objective may be to provide a distribution of polishing medium with different concentration levels of reactants and products across the entire wafer track 62. By progressively increasing the radial spacing of transition points 76 from rotational axis 36 within a groove group 78, a blended residence time for the polishing medium under the wafer is achieved. This would expose different locations under the wafer more uniformly to polishing medium containing different concentrations of reactants and products. Such blended residence time may also be achieved with other patterns or arrangements in the spacing of transition points 76 from rotational axis 36. As those skilled in the art are aware, the design objective of uniform distribution of polishing medium with different concentration levels of reactants and products across the entire wafer track 62 can be obtained through evaluation of the chemistry of polishing medium 46 and its interaction with wafer 32, consideration and analysis of materials included in the wafer, computer modeling of pad 20 and empirically through the use of prototype pads having different design attributes, as discussed above.

Figure 4:
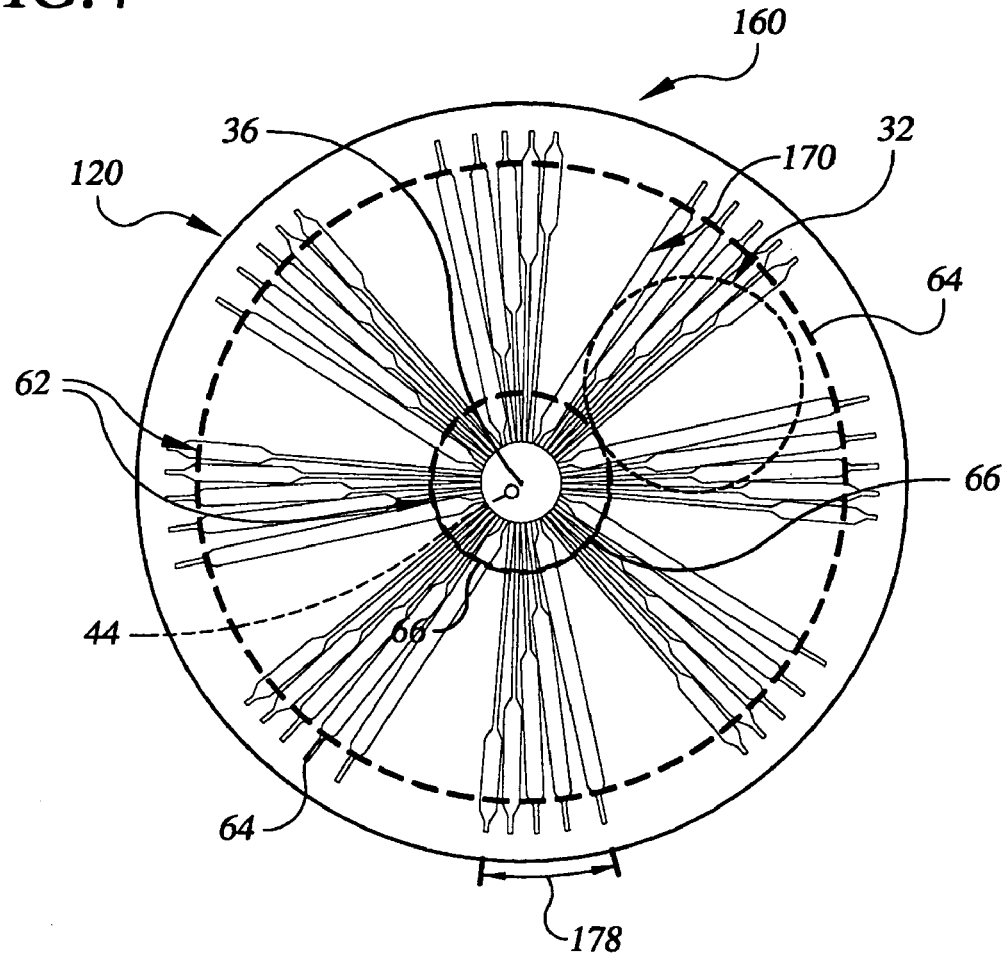
FIG. 4 is a top view of a second embodiment of the polishing pad of the present invention.
Figure 5:
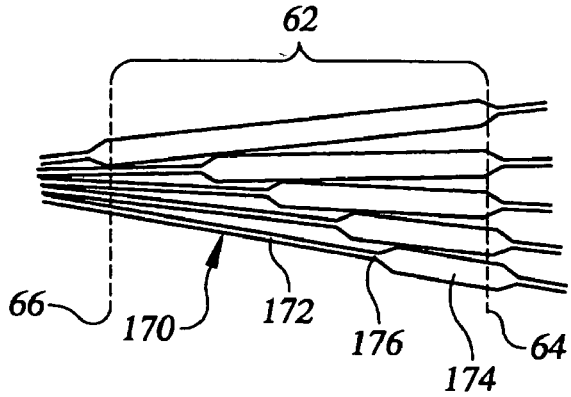
FIG. 5 is an enlarged top view of a section of several of the grooves of the pad shown in FIG. 4.

Turning next to FIGS. 1, 4 and 5, in another embodiment of the present invention a polishing pad 120 having an alternative groove network 160 is provided. Groove network 160 includes a plurality of grooves 170, each having a first portion 172 that is identical to first portion 72, as described above. At transition point 176, the width of each groove 170 increases so as to form a second portion 174. First portion 172 of groove 170 is in fluid communication with the second portion 174 of the groove.

Second portion 174 generally has a substantially uniform width and depth from transition point 176 to at least the portion of second portion 174 that intersects radially outer circle 64. In some cases, however, one or both of the width and depth of grooves 170 in second portion 174 may vary, as determined along a line extending radially outward from rotational axis 36. In an exemplary embodiment of polishing pad 120, grooves 170 in second portion 174 have width in the range of 5–100 mils (0.127–2.54 mm) and a depth in the range of 10 to 30 mils (0.254–0.762 mm). Second portion 174 will often have a substantially straight configuration and extend radially outward from rotational axis 36. The present invention, however, encompasses curved second portions 174. Optionally, the width of second portion 174 may be decreased radially outward of outer circle 64 to a width similar to that of first portion 172.

Grooves 170 are arranged in groove groups 178 so that transition points 176 are typically spaced different radial distances from rotational axis 36. This configuration is identical to the relative placement of transition points 76 of grooves 70, as described above. As with grooves 70, grooves 170 are typically positioned as densely as possible on polishing pad 160, although this placement of the grooves is not mandatory.

In operation, grooves 170 of polishing pad 120 control the residence time of reaction products in polishing medium 46 carried in the grooves in substantially the same manner as grooves 70, as described above. In particular, because the width of second portion 174 is greater than the width of first portion 172, assuming a constant depth of the grooves, the velocity at which the polishing medium flows through the grooves decreases after the polishing medium passes transition point 176 and enters the second portion. As described above relative to grooves 70, the precise configuration of grooves 170 will typically be influenced by the chemistry of polishing medium 46, the composition of wafer 32, and other factors known to those skilled in the art.

Figure 6:
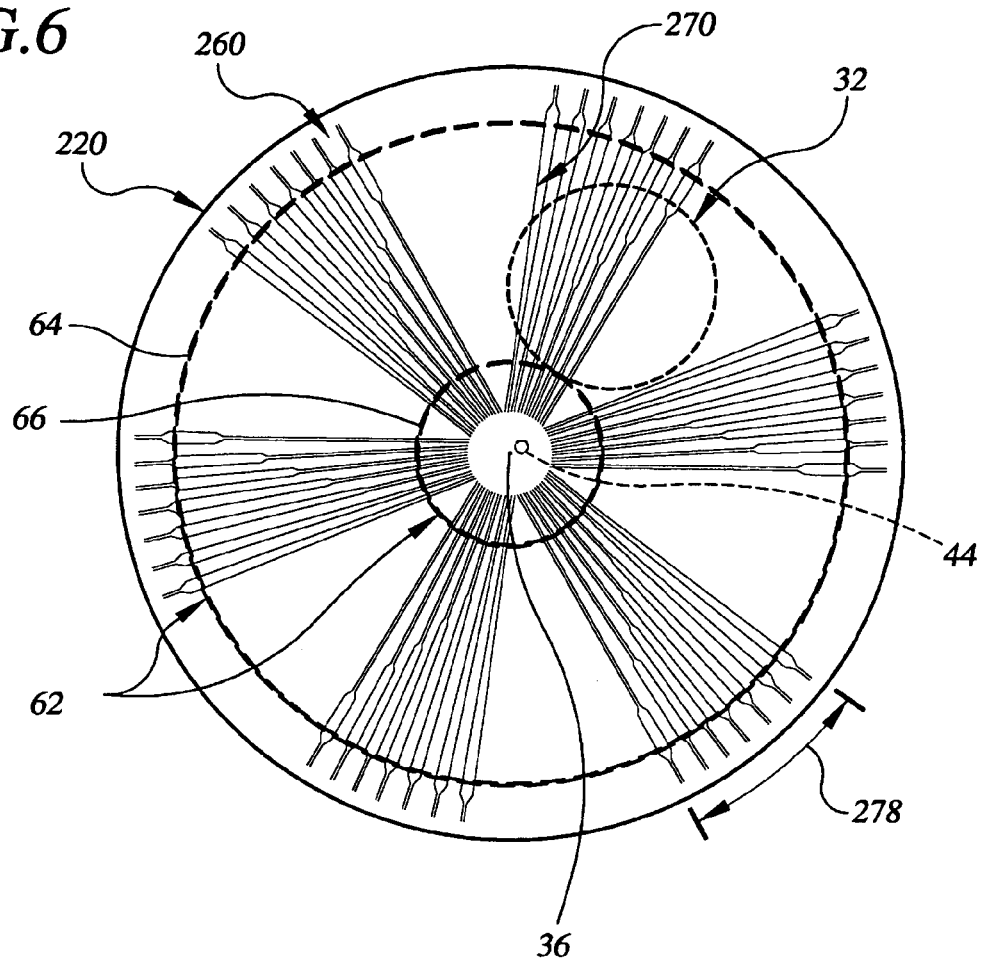
FIG. 6 is a top view of a third embodiment of the polishing pad of the present invention.
Figure 7:
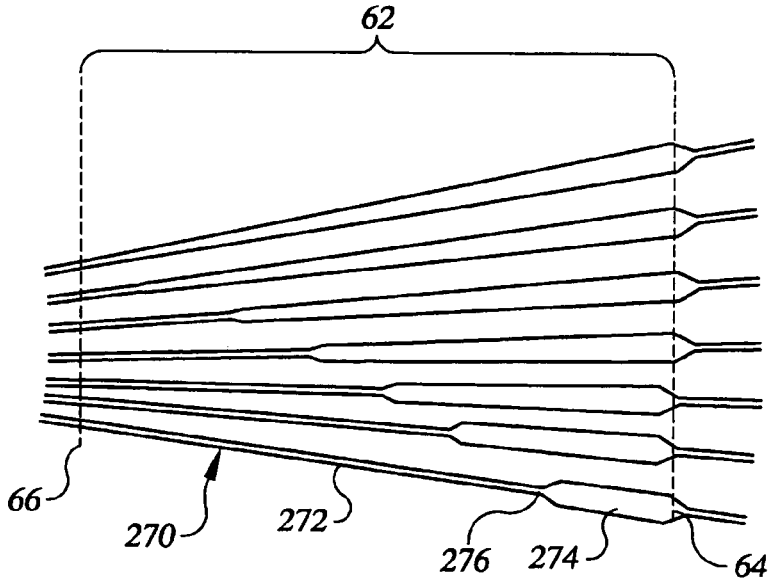
FIG. 7 is an enlarged top view of a section of several of the grooves of the pad shown in FIG. 6.

Referring now to FIGS. 1, 6 and 7, in yet another embodiment of the present invention a polishing pad 220 having an alternative groove network 260 is provided. Groove network 260 includes a plurality of grooves 270, each having a first portion 272 that is identical to first portion 72, as described above. At transition point 276, the width of each groove 270 increases so as to form a second portion 274. First portion 272 of groove 270 is in fluid communication with second portion 274 of the groove. Second portion 274 generally has a width that increases progressively from transition point 276 to at least the portion of second portion 274 that intersects radially outer circle 64, as measured radially outward from rotational axis 36. For some applications it may be advantageous to increase the width of second portion 274 relatively slowly at first and then more rapidly, or vice versa, as measured radially outward from rotational axis 36. Second portion 274 also generally has a uniform depth, although the invention is not so limited. Second portion 274 will often have a substantially straight configuration and extend radially outward from rotational axis 36. The present invention, however, encompasses curved second portions 274.

Grooves 270 are arranged in groove groups 278 so that transition points 276 typically, but not necessarily, are spaced at different radial distances from rotational axis 36. This configuration is identical to the relative placement of transition points 76 of grooves 70, as described above. As with grooves 70, grooves 270 are typically positioned as densely as possible on polishing pad 260, although the present invention encompasses less than maximally dense placement of the grooves.

In operation, grooves 270 of polishing pad 220 control the residence time of reaction products in polishing medium 46 carried in the grooves in substantially the same manner as grooves 70, as described above. In particular, because the width of second portion 274 is greater than the width of first portion 272, assuming a constant depth of the grooves, the velocity at which the polishing medium flows through the grooves decreases after the polishing medium passes transition point 276 and enters the second portion. The progressive increase in the width of grooves 270 in second portion 274 increasingly slows the radially outward flow of polishing medium 46, which in turn results in a progressive increase in residence time of polishing medium 46 transported in the grooves. As described above relative to grooves 70, the precise configuration of grooves 270 will typically be influenced by the chemistry of polishing medium 46, the composition of wafer 32, and other factors known to those skilled in the art.

Figure 8:
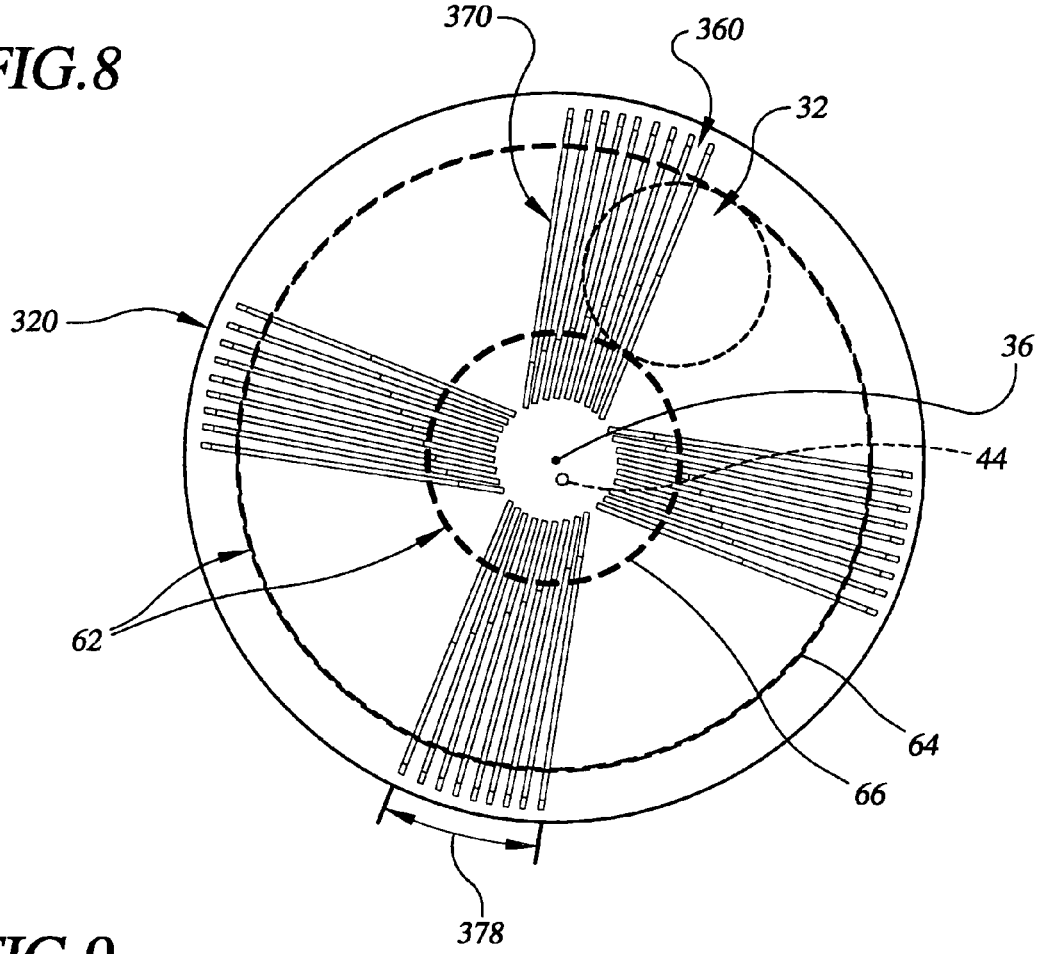
FIG. 8 is a top view of a fourth embodiment of the polishing pad of the present invention.
Figure 9:
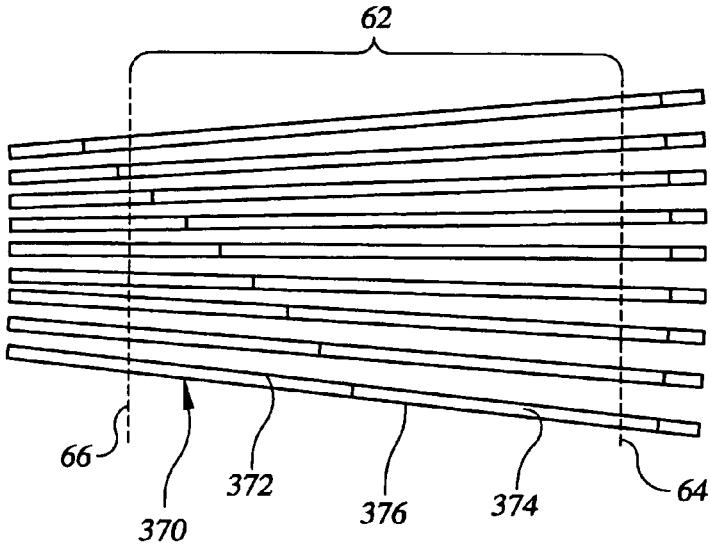
FIG. 9 is an enlarged top view of a section of several of the grooves of the pad shown in FIG. 8.

Referring now to FIGS. 1, 8 and 9, in yet another embodiment of the present invention a polishing pad 320 having an alternative groove network 360 is provided. Groove network 360 includes a plurality of grooves 370, each having a first portion 372 that is identical to first portion 72, as described above. At transition point 376, the depth of each groove 370 increases so as to form a second portion 374. This change in depth is usually achieved gradually, although in some cases a step transition may be acceptable. First portion 372 of groove 370 is in fluid communication with the second portion 374 of the groove.

Second portion 374 may have a depth that is uniform between transition point 376, or more particularly the location adjacent to the transition point at which the second portion has achieved full depth, and at least outer circle 64, as measured radially outward from rotational axis 36. In one embodiment of the invention, first portion 372 has a depth in the range of 5 to 10 mils (0.127–0.254 mm) and second portion 374 has a depth in the range of 10 to 40 mils (0.254–1.016 mm). For some applications, however, it may be desirable to form second portion 374 so that its depth increases progressively from transition point 376 to outer circle 64, as measured radially outward from rotational axis 36. When second portion 374 is so configured, its depth increases an amount in the range 5 to 40 mils (0.127–1.016 mm), as measured between transition point 376 and outer circle 66. Second portion 374 also generally has a uniform width, although the invention is not so limited. Second portion 374 will often have a substantially straight configuration and extend radially outward from rotational axis 36. The present invention, however, encompasses curved second portions 374.

Grooves 370 are arranged in groove groups 378 so that transition points 376 typically, but not necessarily, are spaced progressively radially further from rotational axis 36, as measured from one side of the groove group to the other. This configuration is identical to the relative placement of transition points 76 of grooves 70, as described above. As with grooves 70, grooves 370 are typically positioned as densely as possible on polishing pad 360, although the present invention encompasses less than maximally dense placement of the grooves.

In operation, grooves 370 of polishing pad 320 control the residence time of polishing medium 46 carried in the grooves in substantially the same manner as grooves 70, as described above. In particular, because the depth of second portion 374 is greater than the depth of first portion 372, assuming a constant width of grooves 370, the velocity at which the polishing medium flows through the grooves decreases after the polishing medium passes transition point 376 and enters the second portion. As described above relative to grooves 70, the precise configuration of grooves 370 will typically be influenced by the chemistry of polishing medium 46, the composition of wafer 32, and other factors known to those skilled in the art.

What is claimed is:

1. A polishing pad for polishing an article, the polishing pad comprising:

a. a polishing portion having a rotational axis and a plurality of grooves, each groove including:

i. a first portion; and ii. a second portion in communication with the first portion at a transition location; and b. wherein the transition location of at least a first one of the plurality of grooves is spaced a first radial distance from the rotational axis and the transition location of at least a second one of the plurality of grooves is spaced a second radial distance from the rotational axis, the first radial distance being different than the second radial distance.

2. The pad according to claim 1, wherein the plurality of grooves are arranged in at least two groups of grooves and each groove in the at least two groups of grooves has a transition location that is spaced a radial distance from the rotational axis that differs from the transition location of at least one other groove in the at least two groups of grooves.

3. The pad according to claim 1, wherein the polishing portion has a wafer track and the transition locations of the plurality of grooves are positioned within the wafer track at more than two different distances from the rotational axis.

4. The pad according to claim 1, wherein the transition locations of the plurality of grooves are spaced a plurality of different radial distances from the rotational axis and the transition locations have different residence times of polishing medium within the plurality of grooves across the polishing portion.

5. The pad according to claim 1, wherein the first portion has a different configuration than the second portion, and at least one of the first and second portions has a major axis that extends outward from the rotational axis.

6. A method of polishing an article using a polishing pad having a rotational axis and a polishing medium, the method comprising the steps of:

a. providing a pad having a plurality of grooves that extends outward from the rotational axis;

b. engaging the pad with a surface of the article;

c. effecting relative rotation between the pad and the article so that a track of the pad contacts the article; and d. causing the polishing medium to flow between the track of the pad and the surface of the article within the plurality of grooves with different residence times in at least two of the plurality of grooves.

7. The method according to claim 6, wherein the plurality of grooves are arranged in at least two groups of grooves and each groove in the at least two groups of grooves has a transition location that is spaced a radial distance from the rotational axis that differs from the transition location of at least one other groove in the at least two groups of grooves.

8. A polishing pad for polishing an article with the use of a polishing medium, the pad comprising:

a. a polishing portion having rotational axis and a plurality of grooves, each groove including:

i. a first portion; and ii. a second portion in communication with the first portion at a transition location, the second portion having a length and a cross-sectional configuration that varies along at least a portion of the length so as to increase residence time of polishing medium located in the second portion; and b. wherein the transition location of each of the plurality of grooves is spaced one of a plurality of different radial distances from the rotational axis.

9. The pad according to claim 8, wherein the cross-sectional configuration of the second portion increases in width beginning at the transition location.

10. The pad according to claim 8, wherein the cross-sectional configuration increases from a first width to a second width, the second width increasing progressively from the transition location to locations radially outward of the transition location.

* * * * *